US006896739B1

(12) United States Patent
Croce

(10) Patent No.: US 6,896,739 B1
(45) Date of Patent: May 24, 2005

(54) ANTI-TARNISH AQUEOUS TREATMENT

(75) Inventor: Scott M. Croce, East Brunswick, NJ (US)

(73) Assignee: For Your Ease Only, Inc., Chicago, IL (US)

( * ) Notice: Subject to any disclaimer, the term of this patent is extended or adjusted under 35 U.S.C. 154(b) by 0 days.

(21) Appl. No.: 10/728,477

(22) Filed: Dec. 3, 2003

(51) Int. Cl.[7] ..... C23G 1/02

(52) U.S. Cl. ..... 134/2; 134/3; 134/26; 134/28; 134/34; 134/36; 134/41; 510/201; 510/202; 510/206; 510/245; 510/254; 510/263; 510/269; 510/270; 510/363

(58) Field of Search ..... 510/201, 202, 510/206, 245, 254, 263, 269, 270, 363; 134/2, 3, 26, 28, 34, 36, 41

(56) References Cited

U.S. PATENT DOCUMENTS

| | | | | |
|---|---|---|---|---|
| 1,947,180 | A | 2/1934 | Bart | |
| 2,393,866 | A | 1/1946 | Wassell | |
| 2,450,861 | A * | 10/1948 | Robinson | 510/259 |
| 3,330,672 | A | 7/1967 | Kroll et al. | |
| 3,413,231 | A | 11/1968 | Kolodny et al. | |
| 3,619,962 | A | 11/1971 | Combe | |
| 3,640,736 | A | 2/1972 | Warner et al. | |
| 3,846,139 | A | 11/1974 | Warner | |
| 3,997,361 | A | 12/1976 | Kendall | |
| 4,853,000 | A | 8/1989 | Potter | |
| 6,602,440 | B2 * | 8/2003 | Bishop et al. | 252/79.1 |
| 2002/0098697 | A1 * | 7/2002 | Shimazu et al. | 438/691 |

OTHER PUBLICATIONS

Tarn X Metal Tarnish Remover Brand Information Sheet, Manufacturer: Jelmar, National Institutes of Health, National Library of Medicine, 3 pages.

Brasso Multipurpose Metal Polish Brand Information Sheet, Manufacturer: Reckitt Benckiser Inc., National Institutes of Health, National Library of Medicine, 3 pages.

Brasso Multipurpose Metal Polish–Jun. 27, 2002 Brand Information Sheet, Manufacturer: Reckitt Benckiser Inc., National Institutes of Health, National Library of Medicine, 3 pages.

Cameo Aluminum and Stainless Steel Cleaner Brand Information Sheet, Manufacturer: Church & Dwight Co., National Institutes of Health, National Library of Medicine, 3 pages.

Goddards Long Shine Brass and Copper Polish Brand Information Sheet, Manufacturer: Northern Labs, Inc., National Institutes of Health, National Library of Medicine, 2 pages.

Goddards Long Shine Silver Polish Brand Information Sheet, Manufacturer: Northern Labs, Inc., National Institutes of Health, National Library of Medicine, 2 pages.

Goddards Silver Dip Brand Information Sheet, Manufacturer: Northern Labs, Inc., National Institutes of Health, National Library of Medicine, 3 pages.

Kleen King Copper Cleaner Brand Information Sheet, Manufacturer: Faultless Starch, National Institutes of Health, National Library of Medicine, 3 pages.

KS Brass Neutralizer Brand Information Sheet, Manufacturer: Barr & Co., Inc., W.M., National Institutes of Health, National Library of Medicine, 3 pages.

Old Silver Polish Brand Information Sheet, Manufacturer: Barr & Co., Inc., W.M., National Institutes of Health, National LIbrary of Medicine, 3 pages.

Oneida Rodgers Brass & Copper Polish Brand Information Sheet, Manufacturer: Malco Products, National Institutes of Health, National Library of Medicine, 3 pages.

Oneida Rodgers Silver Polish Brand Information Sheet, Manufacturer: Malco Products, National Institutes of Health, National Library of Medicine, 2 pages.

Sparkle Metal Polisher Brand Information Sheet, Manufacturer: National Chemsearch, National Institutes of Health, National Library of Medicine, 3 pages.

Stainless Steel Magic Cleaner Brand Information Sheet, Manufacturer: Magic American Corp., National Institutes of Health, National Library of Medicine, 3 pages.

Twinkle Copper Cleaner Brand Information Sheet, Manufacturer: Johnson & Son, S.C., Inc., National Institutes of Health, National Library of Medicine, 3 pages.

Twinkle Stainless Steel Cleaner Brand Information Sheet, Manufacturer: JohnsonDiversey, National Institutes of Health, National Library of Medicine, 3 pages.

Twinkle Stainless Steel Cleaner—Nov. 30, 2001 Brand Information Sheet, Manufacturer: JohnsonDiversey, National Institutes of Health, National Library of Medicine, 3 pages.

Wrights Antitarnish Silver Polish Brand Information Sheet, Manufacturer: Wright & Col, J.A., National Institutes of Health, National Library of Medicine, 2 pages.

* cited by examiner

*Primary Examiner*—Sharidan Carrillo
(74) *Attorney, Agent, or Firm*—Merchant & Gould P.C.

(57) ABSTRACT

An aqueous solution that has the capacity for removing tarnish and other soil from copper, silver, gold and other noble metals and alloys thereof comprises an acid, thiourea and a transition metal salt. The aqueous material can be used to treat the surfaces of such articles for the purpose of removing tarnish. Such tarnish is removed by the composition and the composition treats the metal surface to retard the re-appearance of tarnish contaminants.

5 Claims, No Drawings

ANTI-TARNISH AQUEOUS TREATMENT

FIELD OF THE INVENTION

The invention relates to an aqueous solution comprising a combination of soluble ingredients forming a product having tarnish removing and tarnish preventing properties. The invention also relates to a method of cleaning and preserving metal surfaces subject to tarnish formation and formation of similar soil deposits.

BACKGROUND OF THE INVENTION

Many high value products made from copper, silver, gold, other noble metals and alloys thereof can be subject to soiling, dulling or tarnish formation due to atmospheric contaminants, environmental conditions or by handling and use. These metal objects can often form surface deposits of one or more metal oxides or metal sulfides that can be difficult to remove without reducing the appearance, quality or purity of the metal surface. Many mechanical cleaning methods cause scratching or marring of the surface. Chemical cleaners can visually change surface appearance. Cleaners and polishers are available, but involve substantial time and effort in application, are often difficult to use, tend to clean unevenly and fail often to remove all tarnish or prevent the reformation of an undesirable deposit on the surface.

Aqueous solutions are known in the art for the purpose of removing stains, corrosion or dirt from metal surfaces including, for example, Kendall, U.S. Pat. No. 3,997,361, disclosing a phosphoric acid, nitric acid combination in high concentration for tarnish removal. Warner et al., U.S. Pat. No. 3,640,736 and Warner, U.S. Pat. No. 3,846,139, teach organic thiol compositions that can be used for silver and copper tarnish removal. Combe, U.S. Pat. No. 3,619,962, teaches a liquid abrasive cleaner having a substantially basic pH and an abrasive to remove tarnish from silver and copper. Kolodny et al., U.S. Pat. No. 3,413,231, teach specific trivalent phosphorus compounds that impart tarnish resistance to the surface of subject metals. Similarly, Kroll et al., U.S. Pat. No. 3,330,672, relies on thiol compounds, amino compounds, typically quaternary amines, and organic surfactant materials for tarnish removal. Wassell, U.S. Pat. No. 2,393,866, teaches a metal tarnish remover comprising polyethylene oxide organic surfactant materials and other components in an aqueous solution for cleaning purposes. Bart, U.S. Pat. No. 1,947,180, teaches that silver can be made tarnish resistant using a coating of certain metals over the silver surface, typically added by an electroplating step. Other paste-like abrasive cleaning compositions are known that rely on a thickened liquid composition. Such abrasive materials, exemplified by Potter, U.S. Pat. No. 4,853,000, use a thickening agent such as flour or other components with an abrasive and solvent compositions in tarnish removal. Other paste-like silver cleaners have been well known in the art for many years.

One commercial material, Tarn-X® is an aqueous cleaner material comprising an acidified thiourea using a surfactant material and a corrosion inhibitor substance. Tarn-X® generally comprises an aqueous solution containing about 5–7 wt % thiourea, about 3–5 wt % sulfamic acid or hydroxyacetic acid and less than 1% of disodium cocoamphodiproprionate or similar detergent/inhibitor.

These prior art materials, to some degree, are effective in the removal of tarnish from such metal surfaces. Many of the materials, however, do not adequately perform the combination of roles by both removing tarnish and, at the same time, preventing tarnish return.

A substantial need exists in the art for an aqueous material that removes tarnish from metal surfaces rapidly and completely and also prevents the return of such tarnish for at least thirty days, preferably greater than 90 days, when exposed to normal environmental sources of sulfur and other tarnish forming compounds or uses. Of course, its efficacy depends entirely on the concentration of atmospheric sulfur compounds and the degree to which the metal objects are put to tarnish forming use.

BRIEF DISCUSSION OF THE INVENTION

The tarnish removing and tarnish preventing aqueous compositions of the invention comprise a major proportion of water, a sufficient acidifying amount of an acid or acids (10–40 weight %) combined with an active tarnish removing amount of thiourea (10–25 weight %) in combination with one or more transition metals that provide rapid tarnish removal and tarnish prevention to the metal surface. This invention relates to a chemical dip which will lengthen the time between tarnishing of metal surfaces, preferably copper, silver, sterling silver and like alloy materials, from a few weeks to a year or longer. Dipping a tarnished piece, whether tableware or jewelry, into this solution, and allowing it to remain immersed for a short period of time will remove the residual tarnish, brighten the article, and will maintain the metallic brilliance without tarnishing for a significantly longer period than the same silver alloy not treated in this manner.

We have found that in preparation, metal and metal alloys include surface deposits. These microscopic and submicroscopic deposits of metal and metal compounds, such as copper, metal oxides and metal sulfides, on the surface of the silver article are dissolved by strong acid such as the nitric acid or hydrochloric acid in the formula, leaving a relatively pure silver surface exposed. Existing tarnish is also removed by the thiourea, leaving a bright untarnished surface of the article. An effective concentration of a transition metal or transition metal blend in the formula can enhance the tarnish resistance of the surface. Surface analysis of alloy plates treated with the invention solution has shown the presence of a transition metal from the aqueous treatment, indicating the deposition during the treatment process. We believe this deposition is responsible at least in part for the resistance to tarnishing of the silver articles.

Experiments conducted with solutions of thiourea and acid alone have shown the resulting treated articles to be less resistant to tarnishing than similar articles treated with the entire solution containing the cobalt and chromium salts. Silver of 99.999% purity will tarnish when exposed to hostile environments, further verifying the effect of the cobalt salt and chromium salt.

Formulae for the anti-tarnish use solution include:

| Ingredient | Use concentration |
|---|---|
| Acid(s) | 10 to 60% |
| Thiourea | 5 to 25% |
| Transition metal salt(s) | 2 to 30% |
| Water | 60 to 83% |
| Strong Acid(s) | 10 to 60% |
| Thiourea | 5 to 25% |
| Group VI or VIII metal salt | 2 to 30% |
| Water | 60 to 83% |
| Mineral Acid(s) | 10 to 60% |
| Thiourea | 5 to 25% |

-continued

| Ingredient | Use concentration |
|---|---|
| Cobalt salt or chromium salt | 2 to 30% |
| Water | 60 to 88% |

Concentrates of the formulae can be made by increasing the concentration by a factor (e.g.) of 5 to 20. Such concentrates can be diluted to use concentrations by mixing with tap water.

| Ingredient | Concentrate concentration |
|---|---|
| Acid(s) | greater than 50% |
| Thiourea | greater than 25% |
| Transition metal salt(s) | greater than 10% |
| Water | Bal. |
| Strong Acid(s) | greater than 50% |
| Thiourea | greater than 25% |
| Group VI or VIII metal salt | greater than 10% |
| Water | Bal. |
| Mineral Acid(s) | greater than 50% |
| Thiourea | greater than 30% |
| Cobalt salt or chromium salt | greater than 10% |
| Water | Bal |

DETAILED DISCUSSION OF THE INVENTION

The composition and methods for removing tarnish from metal surfaces involve the application of an aqueous solution of and acid or acids, thiourea and a transition metal or metals for the purpose of removing tarnish and preventing its reformation. The aqueous compositions of the invention can contain thiourea or a thiourea equivalent. Thiourea, CAS Registry Number 62-56-6, also known as thiocarbamide has a molecular formula; $CH_4N_2S$ or $NH_2$—(C═S)—$NH_2$, a molecular weight of 76.12 an elemental percent composition of C 15.78%, H 5.30%, N 36.80%, S 42.12%. Thiourea can be made by fusing ammonium thiocyanate, see Powers and Powers, Mitchell, U.S. Pat. Nos. 2,552,584 and 2,560,596; by treating cyanamide with hydrogen sulfide: Robin, Jr., U.S. Pat. No. 2,173,067; Lewis, U.S. Pat. No. 2,393,917 (1946 to Monsanto); Van de Kamp, U.S. Pat. No. 2,357,149. Thiourea crystals have a melting point of 176–178° C., is soluble in 11 parts water, in alcohol and is sparingly soluble in ether and its density is 1.405.

The aqueous cleaning compositions of the invention can contain as a cleaning agent an acid composition that can typically be a strong acid, a weak acid or a strong acid combined with a weak acid or two strong acids. For the purposes of this invention, an acid material is a composition that can be added to an aqueous system and result in a pH less than 7, preferably less than 6. Strong acids that can be used in the aqueous cleaners of the invention include acids which substantially dissociate in an aqueous solution (strong acid) such as nitric acid, hydrochloric acid, sulfuric acid, trichloroacetic acid, trifluoroacetic acid and others. The acid composition comprises a blend of nitric acid and hydrochloric acid, wherein the weight ratio of nitric acid to hydrochloric acid is about 0.01 to 1:1. "Weak" organic and inorganic acids can be used in the invention as a component of the acid cleaner. Weak acids are acids in which the first dissociation step of a proton from the acid cation moiety does not proceed essentially to completion when the acid is dissolved in water at ambient temperatures at a concentration within the range useful to form the present cleaning composition. Such inorganic acids are also referred to as weak electrolytes as the term is used in the text book Quantitative Inorganic Analysis, I. M. Koltoff et al., published by McMillan Co., Third Edition, 1952, pp. 34–37. Most common commercially available weak organic and inorganic acids can be used in the invention. Examples of weak organic and inorganic acids include phosphoric acid, sulfamic acid, acetic acid, hydroxy acetic acid, citric acid, benzoic acid, tartaric acid, maleic acid, malic acid, fumaric acid and the like. We have found in certain applications that mixtures of strong acid with weak acid or mixtures of a weak organic acid and a weak inorganic acid with a strong acid can result in surprisingly increased cleaning efficiency. Such acid cleaners tend to be most effective to clean inorganic soil and tarnish. The soil most commonly cleaned using acid cleaners involves the soils resulting from the reaction of metal in the plate with $O_2$ or sulfur in the air or from skin contact. Other soils that can be removed include soils include dairy residue, soap scum, saponified fatty acids or other marginally soluble anionic organic species that can form a soil precipitate or matrix when combined and contacted with divalent hardness components of service water.

The aqueous compositions of the invention can contain one or more transition metals. We have found that the transition metals, at an appropriate concentration in the aqueous solution, can be deposited on the surface of the metal or metal alloy objects and, as a surface metal at relatively low concentration on the surface, can prevent significant reaction with oxygen or sulfur in the metal environment to prevent further tarnishing of the object. The presence of these transition metals can increase the lifetime of the object tarnish free for an extended period after treatment. The transition metal salts that can be useful in the invention include Group VI(b) (Group designation is the CAS version) metals, Group VII(b) transition metals, Group VIII transition metals, Group II(b) transition metals, Group III(a) transition metals and Group IV(a) metals. Preferred metal salts include salts of Group VI(b) and Group VII(9) transition metal salts. Preferred metals salts include cobalt salts, rhenium salts, iridium salts, chromium salts, molybdenum salts and tungsten salts. A uniquely useful composition includes a mixed metal salt including at least one metal salt of Group VI(b) and a meal salt of Group VIII. Examples of such blends include blends of chromium and cobalt salts, blends of molybdenum and rhenium salts, blends of tungsten and iridium salts. Virtually, any aqueous soluble anion in the salt that can be used to attain the weight percentages of metal in solution can be used. However, for convenience purposes, it is often helpful to use a salt anion that is the complementary anion to the acid used in the aqueous compositions. For example, if nitric acid is used as the acid material in the composition, a nitrate salt can be used. If, for example, a hydroxy acetic acid material is used as the acid, an acetic acid or hydroxy acetic acid salt can be used. Similarly, chloride and be used with HCl. Mixed salts can be use with mixed acids.

The aqueous materials of the invention can be readily prepared simply by blending in acid resistant containers, the acid slowly added to water. Once the acid is dispersed into the water solution in a mixing container, the thiourea acid salts and other components can be carefully added and blended until soluble and uniform.

These useful metal salts include salts of the following metal salts. Cobalt, symbol Co has an atomic weight of 58.933200; an atomic number of 27; potential valences of 1, 2, 3; rarely 4, 5 and is in Group VIII (9). One natural isotope occurs as $^{59}Co$. Artificial radioactive isotopes occur at the atomic weights of 54–58; 60–64. Cobalt is widely distributed in nature with an abundance in earth's crust of 0.001–0.002%. Principle ores of cobalt include cobaltite ($CoS_2.CoAs_2$), linnaeite ($Co_3S_4$), smaltite ($CoAs_2$) and erythrite ($3CoO.As_2O_5.8H_2O$). Cobalt was first isolated in 1735 by Brandt. Reviews of the preparation are found in: Whittemore in *Rare Metals Handbook*, C. A. Hampel, Ed. (Reinhold, New York, 1956) pp 105–146; Houot, *Ann. Mines* 1969 (April), 9–36. Preparation of high purity metal is found in Ware in *Ultrapurification of Semiconductor Materials*, M. S. Brooks, J. K. Kennedy, Eds. (Macmillan, New York, 1962) pp 192–204. Cobalt appears to be essential to life. It plays an important part in animal nutrition; the absence of cobalt-containing vitamin $B_{12}$ causes pernicious anemia. The reactor-produced $^{60}Co$ ($T_{1/2}$ 5.263 years; □-0.314 Mev; □1.173, 1.332 Mev) is a widely used source of radioactivity: Centre d'Information du Cobalt, *Cobalt Monograph* (Brussels, 1960) 515 pp. Comprehensive reviews of cobalt and its compounds can be found in *Cobalt, Its Chemistry, Metallurgy and Uses*, R. S. Young, Ed., A.C.S. Monograph Series, no. 149 (Reinhold, New York, 1960) 424 pp; Nicholls in *Comprehensive Inorganic Chemistry* vol. 3, J. C. Bailar, Jr. et al, Eds. (Pergamon Press, Oxford, 1973) pp 1053–1107; F. Planinsek, J. B. Newkirk in *Kirk-Othmer Encyclopedia of Chemical Technology* vol. 6 (Wiley-Interscience, New York, 3rd ed., 1979) pp 481–494. Cobalt is a gray, hard, magnetic, ductile, somewhat malleable metal. Existing in two allotropic forms; at room temp the hexagonal form is more stable than the cubic form, but both forms can exist at room temperature. Cobalt is stable in air or toward water at ordinary temperature. It has a density of 8.92, melting point of 1493°, boiling point about 3100°, Brinell hardness is 125, latent heat of fusion is 62 cal/g, latent heat of vaporization is 1500 cal/g, specific heat (15–100°): 0.1056 cal/g/° C. Cobalt is readily soluble in dilute $HNO_3$; very slowly attacked by HCl or cold $H_2SO_4$. The hydrated salts of cobalt are red, and the sol salts form red solutions which become blue on adding concentrated HCl. Cobalt has a melting point of 1493°; boiling point about 3100°; with a density of d 8.92.

Rhenium, symbol Re has an atomic weight of 186.207; atomic number of 75; valences 1–7; the heptavalent state being the most stable and is in Group VIIB(7). Two naturally occurring isotopes occur at the following atomic weights 185 (37.07%); 187 (62.93%); the latter is radioactive, $T_{1/2}$~$10^{11}$ years. Artificial radioactive isotopes occur at the atomic weights of 177–184; 186; 188–192. Rhenium occurs in gadolinite, molybdenite, columbite, rare earth minerals, and some sulfide ores. The average concentration in earth's crust is $1\cdot10^{-9}$ (0.001 ppm). Discovery of Rhenium can be found in Noddack et al., *Naturwiss.* 13, 567, 571 (1925). The preparation of metallic rhenium by reduction of potassium perrhenate or ammonium perrhenate is found in Hurd, Brim, *Inorg. Syn.* 1, 175 (1939). Preparation of high purity rhenium is found in Rosenbaum et al., *J. Electrochem. Soc.* 103, 518 (1956). Reviews are found in Melaven in *Rare Metals Handbook*, C. A. Hampel, Ed. (Reinhold, New York, 1954) pp 347–364; Peacock in *Comprehensive Inorganic Chemistry* vol. 3, J. C. Bailar, Jr. et al., Eds. (Pergamon Press, Oxford, 1973) pp 905–978; P. M. Treichel in *Kirk-Othmer Encyclopedia of Chemical Technology* vol. 20 (Wiley-Interscience, New York, 3rd ed., 1982) pp 249–258. Rhenium has hexagonal close-packed crystals, black to silver-gray; a density of 21.02; melting point of 3180°; boiling point of 5900° (estimated); specific heat of 0–20° 0.03263 cal/g/° C.; specific electrical resistance of $0.21\cdot10^{-4}$ ohm/cm at 20°; Brinell hardness of 250; latent heat of vaporization 152 kcal/mol. Rhenium reacts with oxidizing acids, nitric and concentrated sulfuric; but not with HCl. Rhenium has a melting point of 3180°, boiling point of 5900° (estimated) and a density of 21.02.

Iridium, symbol Ir ahs an atomic weight of 192.217; atomic number of 77; valences of 1, 3, 4; also 2, 5, 6 and is in Group VIII(9). Two naturally occurring isotopes occur at the atomic weights of 191 (38.5%); 193 (61.5%). Artificial radioactive isotopes occur at the atomic weights of 182–190; 191; 192; 194–198. Average occurrence in the earth's crust is about 0.001 ppm. Iridium was discovered in 1804 by Tennant. This element occurs in nature in the metallic state, usually as a natural alloy with osmium (osmiridium); found in small quantities alloyed with native platinum (platinum mineral) or with native gold. Recovery and purification from osmiridium is found in Deville, Debray, *Ann. Chim. Phys.* 61, 84 (1861); from the platinum mineral in Wichers, *J. Res. Nat. Bur. Stand.* 10, 819 (1933). Reviews of preparation, properties and chemistry of iridium and other platinum metals are found in Gilchrist, *Chem. Rev.* 32, 277–372 (1943); W. P. Griffith, *The Chemistry of the Rare Platinum Metals* (John Wiley, New York, 1967) pp 1–41, 227–312; Livingstone in *Comprehensive Inorganic Chemistry* vol. 3, J. C. Bailar Jr. et al., Eds. (Pergamon Press, Oxford, 1973) pp 1163–1189, 1254–1274. Iridium is a silver-white, very hard metal; face-centered cubic lattice with a melting point of 2450°; boiling point of ~4500°; a density of $d_4^{20}$ 22.65; the highest specific gravity of all elements; specific heat of 0.0307 cal/g/° C.; and Mohs' hardness of 6.5. Pure iridium is not attacked by any acids including aqua regia; only slightly by fused (non-oxidizing) alkalis. Iridium is superficially oxidized on heating in the air; is attacked by fluorine and chlorine at a red heat; attacked by potassium sulfate or by a mixture of potassium hydroxide and nitrate on fusion; and attacked by lead, zinc or tin. The powdered metal is oxidized by air or oxygen at a red heat to the dioxide, $IrO_2$, but on further heating the dioxide dissociates into its constituents. Iridium has a melting point of 2450°; boiling point of ~4500°; and a density of $d_4^{20}$ 22.65.

Chromium, symbol Cr has an atomic weight of 51.9961; an atomic number of 24; potential valences of 1–6 and is in Group VIB(6). Four naturally occurring isotopes occur at the following atomic weights 50 (4.31%); 52 (83.76%); 53 (9.55%); 54 (2.38%). Artificial radioactive isotopes occur at the atomic weights of 45–49; 51; 55–57. The longest-lived isotope is $^{51}Cr$ ($T_{1/2}$ 27.704 days) and is prepared by (n, γ) reaction from $^{50}Cr$. The abundance in the earth's crust averages about 122 ppm. elemental material can be isolated from crocoite ($PbCrO_4$): L. N. Vauquelin, *J. Mines* 6, ser. 1, 737 (1787); idem, *Ann. Chemie* 70, 70 (1809). Commercial sources obtained from chrome ore typically comprise chromate ($FeO.Cr_2O_3$). Reviews of chromium, its alloys and compounds are found in *Chromium*, M. J. Udy, Ed., A.C.S. Monograph Series, no. 132 (Reinhold, New York, 1956) vol. 1, 433 pp; vol. 2, 402 pp; C. L. Rollinson, "Chromium, Molybdenum and Tungsten" in *Comprehensive Inorganic Chemistry* vol. 3, J. C. Bailar, Jr. et al., Eds. (Pergamon Press, Oxford, 1973) pp 623–700; *Chemistry of the Elements*, N. N. Greenwood, A. Earnshaw, Eds. (Pergamon Press, New York, 1984) pp 1167–1210; J. H. Westbrook in *Kirk-Othmer Encyclopedia of Chemical Technology* vol. 6 (Wiley-Interscience, New York, 4th ed., 1993) pp 228–263; B. J. Page, G. W. Loar, ibid. pp 263–311. A review of biological function of the Cr(III) ion as essential trace elements found in Mertz, *Physiol. Rev.* 49, 163–239 (1969). Review of carcinogenic risk: *IARC Monographs* 2, 100–125 (1973); ibid. 23, 205–323 (1980); of metabolism and toxicity: M. D. Cohen et al., *Crit. Rev. Toxicol* 23, 255–281 (1993); of toxicology and human exposure: *Toxicological Profile for Chromium* (PB93-182434, 1993) 250 pp. Books: *Chromium: Metabolism and Toxicity*, D. Burrows, Ed. (CRC Press, Boca Raton, 1983) 172 pp; *Chromium in the Natural and Human Environments*, J. O. Nriagu, E. Nieboer, Eds. (John Wiley & Sons, New York, 1988) 571 pp. The metal is a steel-gray, lustrous solid in a body-centered cubic crystal structure; that is as hard as corundum and less fusible than platinum. The metal takes a high polish. The metal has a melting point of 1903±10° C., a boiling point of 2642° C., a density ($d^{20}$) of 7.14, a heat capacity (25°) of 5.58 cal/mol/deg C., a heat of fusion of 3.5 kcal/mol, a heat of vaporization of 81.7 kcal/mol (at boiling point), a heat of sublimation (25°) of 94.8 kcal/mol (Rollinson). The metal is resistant to common corroding agents and is highly acid resistant. The metal reacts with dilute HCl, $H_2SO_4$, but not with $HNO_3$. The metal resists atmospheric attack at ambient temperatures.

Molybdenum, symbol Mo has an atomic weight of 95.94; an atomic number of 42; valences of 2, 3, 4, 5, 6 and is in the Group VIB(6). There are several naturally occurring isotopes occur at the following atomic weights of 98 (23.75%); 96 (16.5%); 95 (15.7%); 92 (15.86%); 94 (9.12%); 100 (9.62%); 97 (9.45%). Artificial radioactive isotopes occur at the atomic weights of 88–91; 93; 99; 101–105. Its most important ores are molybdenite, $MoS_2$, and wulfenite, $PbMoO_4$. Occurrence in the earth's crust averages about 1–1.5 ppm. Molybdenum was discovered in 1778 by Scheele and isolated in 1782 by Hjelm. Methods of preparation are found in L. Northcott, *Molybdenum* (Academic Press, New York, 1956) 222 pp; Hein, Herzog, in *Handbook of Preparative Inorganic Chemistry* vol. 2, G. Brauer, Ed. (Academic Press, New York, 2nd ed., 1965) pp 1401–1402. The important trace element; participates in biochemical redox reactions such as $N_2$-fixation is found in Spence, *Coord. Chem. Rev.* 4, 475 (1969). Physical properties are found in Worthing, *Phys. Rev.* [2] 25, 846 (1925); D. R. Stoll, G. C. Sinke, *Thermodynamic Properties of the Elements*, Advances in Chemistry Series 18, (American Chemical Society, Washington, 1956) pp 23, 130–131. Review of molybdenum and its compounds are found in Rollinson, "Chromium, Molybdenum and Tungsten" in *Comprehensive Inorganic Chemistry* vol. 3, J. C. Bailar Jr. et al., Eds. (Pergamon Press, Oxford, 1973) pp 622–623, 700–742; R. Q. Barr in *Kirk-Othmer Encyclopedia of Chemical Technology* vol. 15 (Wiley-Interscience, New York, 3rd ed., 1981) pp 670–682. Biochemical review is found in *Bioinorganic Chemistry* II, K. N. Raymond, Ed. (A.C.S., Washington, 1977) pp 353–430. A symposium on the chemistry and uses of molybdenum and its compounds are found in *Polyhedron* 5, 1–606 (1986). Molybdenum is a dark-gray or black powder with metallic luster or coherent mass of silver-white color; body-centered cubic structure; melting point of 2622° (Worthing); boiling point of ~4825°; density of 10.28; specific heat of 5.68 cal/g-atom/deg; heat of fusion is 6.6 kcal/g-atom; heat of vaporization is 142 kcal/g-atom (Stoll, Sinke). This element is fairly stable at ordinary temperature; oxidized to the trioxide at a red heat; and slowly oxidized by steam. Molybdenum is not attacked by water, by dilute acids or by concentrated hydrochloric acid; practically insoluble in alkali hydroxides or fused alkalis; reacts with nitric acid, hot concentrated sulfuric acid, fused potassium chlorate or nitrate. Molybdenum is attacked by fluorine at ordinary temperature, by chlorine or bromine at a red heat. Molybdenum has a melting point of 2622° (Worthing); boiling point of ~4825° and a density of 10.28.

Tungsten (W) has an atomic weight of 183.84; an atomic number of 74 and is in Group VIB(6). Naturally occurring isotopes are 180 (0.135%); 182 (26.4%); 183 (14.4%); 184 (30.6%); 186 (28.4%); artificial radioactive isotopes are 173–179; 181; 185; 187–189. Tungsten was discovered by C. W. Scheele in 1781, isolated in 1783 by J. J. and F. de Elhuyar. One of the rarer metals, it comprises about 1.5 ppm of the earth's crust. Chief ores are Wolframite [(Fe,Mn) $WO_4$] and Scheelite ($CaWO_4$) found chiefly in China, Malaya, Mexico, Alaska, South America and Portugal. Scheelite ores mined in the U.S. carry from 0.4–1.0% $WO_3$. Description of isolation processes are found in K. C. Li, C. Y. Wang, *Tungsten*, A.C.S. Monograph Series no. 94 (Reinhold, New York, 3rd ed., 1955) pp 113–269; G. D. Rieck, *Tungsten and Its Compounds* (Pergamon Press, New York, 1967) 154 pp. Reviews: Parish, *Advan. Inorg. Chem. Radiochem.* 9, 315–354 (1966); Rollinson, "Chromium, Molybdenum and Tungsten" in *Comprehensive Inorganic Chemistry* Vol. 3, J. C. Bailar, Jr. et al., Eds. (Pergamon Press, Oxford, 1973) pp 623–624, 742–769. Tungsten is a steel-gray to tin-white metal having in crystal form, a body centered cubic structure. Its density is $d_4^{20}$ 18.7–19.3; depends on extent of working, hardness is 6.5–7.5, melting point is 3410° C., boiling point is 5900° C., specific heat (20° C.) is 0.032 cal/g/° C., heat of fusion is 44 cal/g, heat of vaporization is 1150 cal/g and electrical resistivity (20° C.) is 5.5 $\mu$ohm-cm. Tungsten is stable in dry air at ordinary temperatures, but forms the trioxide at red heat, is not attacked by water, but is oxidized to the dioxide by steam. Powdered tungsten can be pyrophoric under the right conditions and is slowly sot in fused potassium hydroxide or sodium carbonate in presence of air; is soluble in a fused mixture of NaOH and nitrate. Tungsten is attacked by fluorine at room temperature; by chlorine at 250–300° C. giving the hexachloride in absence of air, and the trioxide and oxychloride in the presence of air. In summary the melting point is 3410° C., the boiling point is 5900° C. and the density is $d_4^{20}$ 18.7–19.3.

Other useful salts include salts of the following metals. Manganese, symbol Mn has an atomic weight of 54.938049; an atomic number of 25; potential valences of 2, 4, 7; 1, 3, 5, 6 and is in Group VIIB(7). One stable isotope occurs at the atomic weight 55. Artificial radioactive isotopes occur at the atomic weights of 49–54; 56–58. The widely-distributed, abundance averages about 0.085% of the earth's crust. Manganese occurs in the minerals pyrolusite, hausmannite, manganite, braunite ($3Mn_2O_3.MnSiO_3$), manganosite (MnO), and in several others and occurs in minute quantities in water, plants and animals. Manganese was first isolated by Gahn in 1774. The preparation of this metal is found in: John et al., cited by Mellor, *A Comprehensive Treatise on Inorganic and Theoretical Chemistry,* 12, 163 (1932); A. H. Sully, *Manganese* (Academic Press, New York, 1955) 305 pp. A review of the physical properties of manganese is found in Meaden, *Met. Rev.* 13, 97–114 (1968). Reviews of manganese and its compounds are found in: Kemmitt in *Comprehensive Inorganic Chemistry*, vol. 3, J. C. Bailar Jr. et al., Eds. (Pergamon Press, Oxford, 1973) pp 771–876; L. R. Matricardi, J. H. Downing in *Kirk-Othmer Encyclopedia of Chemical Technology* vol. 14, (Wiley-Interscience, New York, 3rd ed., 1981) pp 824–843. Manganese is a steel gray, lustrous, hard, brittle metal. Manganese is superficially oxidized on exposure to air, burns with an intense white light when heated in air, decreases water slowly in the cold, but rapidly on heating. Pure electrolytic manganese is not attacked by water at ordinary temperature and slightly attacked by steam. Manganese reacts with dilute mineral acids with evolution of hydrogen and formation of divalent manganous salts, reacts with aqueous solutions of sodium or potassium bicarbonate. When manganese is heated in nitrogen above 2000°, it burns to form a nitride. It can be converted by fluorine into di- and trifluoride and by chlorine into dichloride. In powder form, manganese reduces most metallic oxides on heating and on heating, reacts directly with carbon, phosphorus, antimony or arsenic. Manganese has a melting point of 1244°; a boiling point of 2095° and density of $d^{20}$ 7.47; $d^{20}$ 7.26; $d^{1100}$ 6.37; $d^{1143}$ 6.28; $d^{20}$ 7.21.

Iron, symbol Fe has an atomic weight of 55.845; an atomic number of 26; potential valences of 2, 3; seldom 1, 4, 6 and is in Group VIII(8). Four naturally occurring isotopes occur at the atomic weights of 54 (5.82%); 56 (91.66%); 57 (2.19%); 58 (0.33%). Artificial radioactive isotopes occur at the atomic weights of 52; 53; 55; 59–61. Iron is the second most abundant metal in earth's crust after aluminum at about 5%. The earth's core is believed to consist mainly of iron. Important ores include hematite ($Fe_2O_3$), magnetite ($Fe_3O_4$), limonite [$FeO(OH).nH_2O$] and siderite $FeCO_3$). The study of iron and its compounds is found in Mössbauer Spectroscopy: Danon, "$^{57}$Fe: Metal, Alloys and Inorganic Compounds" in *Chemical Applications of Mössbauer Spectroscopy*, V. I. Goldanskii, R. H. Herber, Eds. (Academic Press, New York, 1968) p 159–313. Iron ions involved in oxygen transport, electron transport, nitrogen fixation and a number of other biological processes are found in: Nielands, "Evolution of Biological Iron Binding Centers" in *Struct. Bonding* 11, 145–170 (1972). A review of biology, pharmacology and toxicity of iron compounds is found in: by several authors, *Clin. Toxicol.* 4, 525–642 (1971). Comprehensive reviews are found in: Feldmann, Schenck in *Ullmanns Encyklopädie der Technischen Chemie* vol. 6 (München-Berlin, 1955) pp 261–407; Nicholls in *Comprehensive Inorganic Chemistry* vol. 3, J. C. Bailar, Jr. et al., Eds. (Pergamon Press, Oxford, 1973) pp 979–1051; W. A. Knepper in *Kirk-Othmer Encyclopedia of Chemical Technology* vol. 13 (Wiley-Interscience, New York, 3rd ed., 1981) pp 735–753. Iron is a silvery-white or gray, soft, ductile, malleable, somewhat magnetic metal. Iron holds magnetism only after hardening (as alloy steel, e.g., Alnico). Supplied as ingots, powder, wire, sheets, etc., it takes a bright polish and can be rolled, hammered and bent, particularly when red hot. Iron is stable in dry air, but readily oxidizes in moist air forming "rust" (chiefly oxide, hydrated). In powder form it is black to gray in color. Commercial iron usually contains some C, P, Si, S and Mn. The density of pure iron is 7.86; cast iron 7.76; wrought iron 7.25–7.7, and steel 7.6–7.78. The melting point of pure iron is 1535°; cast iron 1000–1300°; wrought iron 1500°; and steel 1300°. The boiling point is 3000°. Electrical resistivity (20°) is 9.71 microhm-cm. Iron is readily attacked by dilute mineral acids and attacked or dissolved by organic acids; is not appreciably attacked by cold concentrated $H_2SO_4$ or $HNO_3$, but is attacked by the hot acids. Iron has a melting point when pure of 1535°; cast iron of 1000–1300°; wrought iron 1500°; and steel of 1300°. Iron has a boiling point of 3000° and a density of when pure of 7.86; cast iron of 7.76; wrought iron of 7.25–7.78; and steel of 7.6–7.78.

Zinc, symbol Zn has an atomic weight of 65.39; an atomic number of 30; a valence of 2 and is in Group IIB(12). The abundance in the earth's crust averages about 0.02% by weight. Five natural isotopes occur at the atomic weights of 64 (48.89%); 66 (27.81%); 68 (18.57%); 67 (4.11%); 70 (0.62%). There are eight radioactive isotopes and two isomers. Zinc occurs in smithsonite or zinc spar, sphalerite or zinc blend, zincite, willemite, franklinite, [(Zn,Mn,Fe)O.($Fe.Mn_2$)$O_3$] or gahnite ($ZnAl_2O_4$). Zinc has been known since very early times. Commercial forms are ingots; lumps; sheets; wire; shot; strips; sticks; granules; mossy; powder (dust). The preparation of zinc is found in: Gowland, Bannister, *Metallurgy of Non-Ferrous Metals* (Griffin, London, 1930); *Zinc Production, Properties and Uses* (Zinc Development Association, London, 1968). Reviews are found in: Zinc, C. H. Mathewson, Ed., A.C.S. Monograph Series no. 142 (Reinhold, New York, 1959) 721 pp; Schlechter, Thompson, "Zinc and Zinc Alloys" in *Kirk-Othmer, Encyclopedia of Chemical Technology*, vol. 22 (Interscience, New York, 2nd ed., 1970) pp 555–603; Aylett, "Group IIB" in *Comprehensive Inorganic Chemistry*, vol. 3, J. C. Bailar, Jr. et al., Eds. (Pergamon Press, Oxford, 1973) pp 187–328. Zinc is a bluish-white, lustrous metal; distorted hexagonal close-packed structure; stable in dry air; and becomes covered with a white coating of basic carbonate on exposure to moist air. It has a melting point of 419.5°; a boiling point 908° and density of $d^{25}$ 7.14, heat capacity at constant pressure is (25°): 6.07 cal/mole deg; Mohs' hardness is 2.5. When zinc is heated to 100–150°, it becomes malleable; when heated to 210° becomes brittle and pulverizable. Zinc burns in air with a bluish-green flame and loses electrons in aqueous systems to form $Zn^{2+}E°$ (aq) $Zn/Zn^{2+}$ 0.763 V. Slowly attacked by $H_2SO_4$ or HCl; oxidizing agents or metal ions, e.g. $Cu^{2+}$, $Ni^{2+}$, $Co^{2+}$, accelerate the process. Zinc reacts slowly with ammonia water and acetic acid, but rapidly with $HNO_3$; reacts with alkali hydroxides to form "zincates", $ZnO_2^{2-}$, which are actually hydroxo complexes such as $Zn(OH)_{3-}$; $Zn(OH)_4^{2-}$, $[Zn(OH)_4(H_2O)_2]^{2-}$. Zinc has a melting point of 419.5°, boiling point of 908° and a density of $d^{25}$ 7.14.

Aluminum, symbol Al has an atomic weight of 26.981538; an atomic number of 13; valence of 3 and is in Group IIIA(13). One naturally occurring isotope (mass number) occurs at an atomic weight of 27 (100%). Artificial radioactive isotopes occur at the atomic weights of 22–25, 26 ($T_{1/2}$ $7.2\cdot10^5$ years, longest-lived known isotope), 28–32. One of the most abundant metals in the earth's crust, it occurs at an average of about 8.3% by wt (83,000 ppm); occurs in nature primarily in combination with silica, also as oxide (see Aluminum Silicate; Aluminum Oxide). Aluminum was first obtained in impure form by Oersted in 1825 and prepared as metal powder by Wöhler in 1827. A commercially important source is bauxite. Reviews of aluminum, its alloys and compounds are found in Brandt, "Aluminum and Aluminum Alloys" in *Proc. Met. Soc. Conf.* vol. 40, E. D. Verink, Ed. (Gordon & Breach, New York, 1966); *Aluminum,* 3 vols. K. R. Van Horn, Ed. (American Society for Metals, Metal Park, Ohio, 1967); Wade, Bannister, "Aluminum, Gallium, Indium and Thallium" in *Comprehensive Inorganic Chemistry* vol. 1, J. C. Bailar, Jr. et al., Eds. (Pergamon Press, Oxford, 1973) pp 993–1064; *Chemistry of the Elements*, N. N. Greenwood, A. Earnshaw, Eds. (Pergamon Press, New York, 1984) pp 243–295; J. T. Stanley, W. Haupin in *Kirk Othmer Encyclopedia of Chemical Technology* vol. 2 (John Wiley & Sons, 4th ed., 1992) pp 184–251; W. C. Sleppy et al., ibid. 252–345. Review of clinical toxicology is found in C. D. Hewitt et al., *Clin. Lab. Med.* 10, 403–422 (1990); of toxicology and human exposure is found in *Toxicological Profile for Aluminum and Compounds* (PB93-110633, 1992) 158 pp. Book: *Chemistry of Aluminum, Gallium, Indium and Thallium*, A. J. Downs, Ed. (Blackie Academic & Professional, London, 1993) 515 pp. Aluminum is a tin-white, malleable, ductile metal, with somewhat bluish tint; capable of taking brilliant polish which is retained in dry air. In moist air, oxide film forms which protects metal from corrosion. Aluminum is available in bars, leaf, powder, sheets, or wire and has a density of d 2.70, melting point of 660° and a boiling point of 2327°. Aluminum does not vaporize even at high temperatures, but finely divided aluminum dust is easily ignited and may cause explosions. Aluminum reacts with dilute HCl, $H_2SO_4$, KOH and NaOH with evolution or hydrogen. This metal reduces the cations of many heavy metals to the metallic state E°(aq) $Al^{3+}/Al$ −1.66 V. Solutions of $Al^{3+}$ in dilute HCl or neutral or slightly acid solutions of most aluminum salts, yield with $Na_2S$, a white precipitate soluble in excess of $Na_2S$. Dilute neutral solution of aluminum salts yields white gelatinous precipitate on boiling with sodium acetate. Aluminum has a melting point of 660°, boiling point of 2327° and a density of d 2.70.

Silicon, symbol Si has an atomic weight of 28.0855; an atomic number of 14; valences of 4 and 2 and is in Group IVA(14). Three naturally occurring isotopes occur at the following atomic weights 28 (92.18%); 29 (4.71%); 30 (3.12%). Artificial isotopes occur at the atomic weights of 25–27; 31; 32. Silicon does not occur free in nature; but is found as silica (quartz, sand, sandstone) or as silicate (feldspar or orthoclase, kaolinite, anorthite, etc.). Constituting about 27.6% of the earth's crust, it is the second most abundant element on earth with oxygen being first. Silicon can be prepared industrially by carbon reduction of silica in an electric arc furnace. Silicon purification is attained by zone refining (see ref under Germanium). Very pure silicon is obtained by decomposition of silicon tetraiodide as is found in Litton, Anderson, *J. Electrochem. Soc.* 101, 287 (1954); *Chem. & Eng. News* 34, 5007 (1956); from silicon tetrachloride is found in Lyon et al., *Trans. Electrochem. Soc.* 96, 359 (1949); Klyuchnikov, *J. Appl. Chem. USSR* 29, 139 (1956); by thermal decomposition of a chlorosilane is found in Schering, U.S. Pat. No. 3,041,144 (1962 to Siemens-Schuckertwerke). Reviews of silicon and its compounds are found in Rochow, "Silicon" in *Comprehensive Inorganic Chemistry* vol. 1, J. C. Bailar, Jr. et al., Eds. (Pergamon Press, Oxford, 1973) pp 1323–1467; W. Runyan in *Kirk-Othmer Encyclopedia of Chemical Technology* vol. 20 (Wiley-Interscience, New York, 3rd ed., 1982) pp 826–845. The uses of silicon compounds in organic chemistry are found in E. W. Colvin, *Chem. Soc. Rev.* 7, 15 (1978); I. Fleming, ibid. 10, 83 (1981); L. A. Paquette, *Science* 217, 793 (1982). Silicon is black to gray, lustrous, needle-like crystals or octahedral platelets (cubic system). The amorphous form is a dark brown powder. It is a poor conductor of electricity, has a density of $d_4^{25}$ 2.33, a melting point of 1410°, an average heat capacity (16–100°) of 0.1774 cal/g/° C.; lattice constant (25°) of 5.41987□$10^{-8}$ cm. Silicon's compressibility ($V/V_0$) at 25□$10^3$ kg/cm$^2$ is 0.978; at $100\cdot10^3$ kg/cm$^2$: 0.940, *Gmelin's Silicon* (8th ed.) 15B (1959) p 57; and dielectric construction is 13. Covalent bond ionization energy at 0° K=1.2 ev., band gap is 1.106 ev.; impurity atom ionization energy is ~0.04 ev.; intrinsic resistivity at 300° K=0.23 megohm; electron mobility at 300° K is 1500 cm$^2$/volt/sec.; hole mobility at 300° K is 500 cm$^2$/volt/sec.; intrinsic charge density at 300° K is $1.5\cdot10^{10}$; electron diffusion constant at 300° K is 38; hole diffusion constant at 300° K is 13. Silicon is practically insoluble in water. It is attacked by hydrofluoric or a mixture of hydrofluoric and nitric acids (depending upon crystallized modifications) and soluble in molten alkali oxides. Silicon burns in fluorine and chlorine. Silicon has a melting point of 1410°; a density of $d_4^{25}$ 2.33.

Germanium, symbol Ge has an atomic weight of 72.61; an atomic number of 32; valences of 4 and 2 and is in Group IVA(14). Five naturally occurring isotopes occur at the following atomic weights 70 (20.55%); 72 (27.37%); 73 (7.67%); 74 (36.74%); 76 (7.67%). Artificial radioactive isotopes occur at the atomic weights of 65–69; 71; 75; 77; 78. The occurrence of germanium in the earth's crust is about 0.0007%. This element was predicted and called ekasilicon by Mendéleeff. Germanium was discovered in 1886 by Clemens Winkler as found in *J. Prakt. Chem.* 34, 177 (1886). It is obtained industrially from the flue dusts of smelters processing zinc-bearing ores as found in Jaffee et al., *Trans. Electrochem. Soc.* 89, 277 (1946). Purification by zone refining is found in Pfann, *J. Metals* 4, 747 (1952). Physical properties are be found in Hassion et al., *J. Phys. Chem.* 59, 1076 (1955). Inhalation toxicity studies are found in J. H. E. Arts et al., *Food Chem. Toxicol,* 28, 571 (1990). For review and description of modern isolation techniques, see Pirest in L. P. Hunter, *Handbook of Semiconductor Electronics* (McGraw-Hill, New York, 1956), section 6. Comprehensive monograph is found in V. I. Davydov, *Germanium* (Gordon & Breach, New York, 1966) 417 pp. Other reviews of interest are found in *Rochow in Comprehensive Inorganic Chemistry*vol. 2, J. C. Bailar, Jr. et al., Eds. (Pergamon Press, Oxford, 1973) pp 1–41; J. H. Adams in *Kirk-Othmer Encyclopedia of Chemical Technology* vol. 11 (Wiley-Interscience, New York, 3rd ed., 1980) pp 791–802. Germanium is a grayish-white, lustrous, brittle metalloid, diamond-cubic structure when crystallized, poor conductor of electricity, has a density of $d_4^{25}$ 5.323. Reported melting points range from 925–975°; best value 937.2° (Hassion). Germanium has a smaller volume by a few % when molten, boiling point of 2700, thermal expansion coefficient (at ~25°) is $6.1\cdot10^{-6}$/° C.; thermal conductivity (at 25°) is 0.14 cal/sec cm/° C.; specific heat (0–100°) is 0.074 cal/g/° C.; lattice constant at 25° is 5.657□$10^{-8}$ cm; atoms/cc=$4.42\cdot10^{22}$; volume compressibility is $1.3\cdot10^{-12}$ cm$^2$/dyn; dielectric constant is 16; covalent bond ionization energy at 0° K=1.2 ev; band gap is 0.67 ev.; impurity atom ionization energy: ~0.01 ev.; intrinsic resistivity at 300° K=47 ohm-cm; electron mobility at 300° K=3900 cm$^2$/v sec; hole mobility at 300° K=1900 cm/v sec; intrinsic charge density at 300° K=$2.4\cdot10^{13}$; electron diffusion constant at 300° K=100; hole diffusion constant at 300° K=49. Germanium is insoluble in water, hydrochloric acid, dilute alkali hydroxides. It is attacked by aqua regia, concentrated nitric or sulfuric acids, fused alkalis, alkali peroxides, nitrates, or carbonates. Although relatively stable and unaffected by air, it becomes oxidized above 600°; is slowly oxidized by hydrogen peroxide at room temperature, fairly rapidly at 90°; and is attacked by hydrogen above 1000°. When finely divided, it burns in chlorine or bromine. It has a melting points that range from 925–975°; best value 937.2° (Hassion), boiling point of 2700°, and a density of $d_4^{25}$ 5.323.

Indium, symbol In has an atomic weight of 114.818; atomic number of 49; valences 3, 2, 1 and is in Group IIIA(13). Natural isotopes occur at the atomic weights of 115 (95.77%); 113 (4.23%); $^{115}$In has a $T_{1/2}$ $6\cdot10^{14}$ years. Artificial radioactive isotopes occur at the atomic weights of 107–112; 114; 116–124. Occurrence in the earth's crust averages about $1\cdot10^{-5}$%. Indium was discovered in sphalerite ore by Reich and Richter in 1863. It is generally found in zinc blends as found in Monograph: M. T. Ludwick, *Indium* (Indium Corp. of America, Utica, N.Y., 1950). Reviews can be found in Wade, Banister in *Comprehensive Inorganic Chemistry* vol. 1, J. C. Bailar, Jr. et al., Eds. (Pergamon Press, Oxford, 1973) pp 997–1000, 1065–1117; E. F. Milner, C. E. T. White in *Kirk-Othmer Encyclopedia of*

*Chemical Technology* vol. 13 (Wiley-Interscience, New York, 3rd ed., 1981) pp 207–212. Indium is a soft, white metal with bluish tinge and emits a "tin cry" on bending. It is ductile, malleable, softer than lead, and leaves a mark on paper. Indium is quite stable in air, crystallizes and is diamagnetic; has a density of $d^{20}$ 7.3; a melting point of 155°; a boiling point of 2000°; specific heat is 0.0568 cal/g/° C.; Mohs' hardness=1.2; is unaffected by water; attacked by mineral acids, but is very resistant to alkalis. Indium has a melting point of 155°, boiling point of 2000° and has a density of $d^{20}$ 7.3.

Tin, symbol Sn has an atomic weight of 118.710; atomic number of 50; valences 2 and 4; and is in Group IVA(14). Naturally occurring isotopes occur at the atomic weights of 112 (0.95%); 114 (0.65%); 115 (0.34%); 116 (14.24%); 117 (7.57%); 118 (24.01%); 119 (8.59%); 120 (32.97%); 122 (4.71%); 124 (5.98%). Artificial radioactive isotopes occur at the atomic weights of 108–111; 113; 121; 123; 125–132. Tin is found in cassiterite, stannite, and tealite. Average occurrence in earth's crust is 6 □$10^{-4}$%. The metal of commerce is about 99.8% pure. Preparation of high purity tin is found in Baralis, Marone, *Met. Ital.* 59, 494 (1967), C. A. 67, 119613a (1967). Physical properties of tin are found in Kirshenbaum, Cahill, *J. Inorg. Nucl. Chem.* 25, 232 (1963). *Monograph*: C. L. Mantell, *Tin: Its Mining, Production, Technology and Applications* (Reinhold, New York, 1949). Reviews are found in Abel in *Comprehensive Inorganic Chemistry* vol. 2, J. C. Bailar, Jr. et al., Eds. (Pergamon Press, Oxford, 1973) pp 43–104; W. Germain et al., in *Kirk-Othmer Encyclopedia of Chemical Technology* vol. 23 (Wiley-Interscience, New York, 3rd ed., 1983) pp 18–42. Tin is an almost silver-white, lustrous, soft, very malleable and ductile metal; only slightly tenacious; easily powdered. When being bent, tin emits the crackling "tin cry". Tin becomes brittle at 200° and at −40° crumbles to gray amorphous powder ("gray tin"), slowly changing back above 20° to white tin. It is available in the form of bars, foil, powder, shot, etc.; is stable in air, but when in powder form it oxidizes, especially in presence of moisture; has a density of 7.31; melting point of 231.9°; boiling point of 2507° (2780° K); specific beat of (25°) 0.053 cal/g/° C.; Brinell hardness of 2.9. Tin reacts slowly with cold dilute HCl or dilute $HNO_3$, hot dilute $H_2SO_4$; readily with concentrated HCl, aqua regia; very slowly attacked by acetic acid; slowly attacked by cold, more readily by hot caustic alkali; concentrated $HNO_3$ converts it into insoluble metastannic acid. Tin has a melting point of 231.9°, boiling point of 2507° (2780° K) and a density of 7.31.

Bismuth, symbol Bi has an atomic weight of 208.98038; atomic number of 83; valences of 3, 5 and is in Group VA(15). One naturally occurring isotope occurs with an atomic weight of 209. Artificial radioactive isotopes occur at the atomic weights of 199–208; 210–215. Bismuth was confused with tin until 1450. It was first isolated by Hillot in 1737. It was, however, Geoffrey the Younger who clearly proved its individuality in 1753. Pott and Bergmann are named as the scientific discoverers. Average occurrence in the earth's crust is approximately 0.2 ppm. Bismuth is obtained as a by-product from the processing of lead, copper, and tin ores. Reviews are found in *Nouveau Traitëde Chimie Minërale*, tome 11, P. Pascal, Ed. (Masson, Paris, 1958); *Gmelin's, Bismuth* (8th ed.) 19, pp 1–104 (1927); supplement, pp 1–621 (1964); Smith, "Arsenic, Antimony and Bismuth" in *Comprehensive Inorganic Chemistry* vol. 2, J. C. Bailar, Jr. et al., Eds. (Pergamon Press, Oxford, 1973) pp 547–683; S. C. Carapella, H. E. Howe in *Kirk-Othmer Encyclopedia of Chemical Technology* vol. 3 (Wiley-Interscience, New York, 3rd ed., 1978) pp 912–921. Bismuth is a grayish-white with reddish tinge and bright metallic luster, soft and brittle; superficially oxidized by air, frequently becoming iridescent. It has a melting point of 271°; contracts when melted; has a boiling point of 1420°. Boiling point of 1490° is found in *Gmelin's*, p. 43. $d_4^{20}$ 9.78; $d_4^{271}$ 10.07. Bismuth is considered a poor conductor of electricity; has the greatest Hall effect of any metal, i.e., its resistance increases when placed in a magnetic field. Bismuth is attacked by dilute $HNO_3$, hot $H_2SO_4$, concentrated HCl. Cold solutions of Bismuth give a white precipitate with NaOH, turning yellow on boiling; with HCl a white precipitate solution in excess of acid. The solutions in HCl or $HNO_3$ yield with much water a white precipitate blackened by $H_2S$ (different from Sb). Bismuth has a melting point of 271°, a boiling point of 1420°; boiling point of 1490° is found in *Gmelin's*, p. 43 and a density of $d_4^{20}$ 9.78; $d_4^{271}$ 10.07.

Although the salts indicated in the formula are the nitrates, we do not wish to be bound by these compounds exclusively. Chlorides, carbonates, sulfates, and other soluble related compounds could possibly exert a similar effect if substituted for the nitrates.

The aqueous cleaning compositions of the invention can contain an organic surfactant composition to either increase surface wetting or soil removal that are often used in amounts of about 0.01 to 5 wt.-% depending on soil type, soiled surface and other known variables. Anionic, nonionic, cationic or amphoteric surfactants can be used. Anionic materials that can be used in the aqueous compositions of the invention are surfactants containing a large lipophilic moiety and a strong anionic group. Such anionic surfactants contain typically anionic groups selected from the group consisting of sulfonic, sulfuric or phosphoric, phosphonic or carboxylic acid groups which when neutralized will yield sulfonate, sulfate, phosphonate, or carboxylate with a cation thereof preferably being selected from the group consisting of an alkali metal, ammonium, alkanol amine such as sodium, ammonium or triethanol amine. Examples of operative anionic sulfonate or sulfate surfactants include alkylbenzene sulfonates, sodium xylene sulfonates, sodium dodecylbenzene sulfonates, sodium linear tridecylbenzene sulfonates, potassium octyldecylbenzene sulfonates, sodium lauryl sulfate, sodium palmityl sulfate, sodium cocoalkyl sulfate, sodium olefin sulfonate. Nonionic surfactants carry no discrete charge when dissolved in aqueous media. Hydrophilicity of the nonionic is provided by hydrogen bonding with water molecules. Such nonionic surfactants typically comprise molecules containing large segments of a polyoxyethylene group in conjunction with a hydrophobic moiety or a compound comprising a polyoxypropylene and polyoxyethylene segment. Polyoxyethylene surfactants are commonly manufactured through base catalyzed ethoxylation of aliphatic alcohols, alkyl phenols and fatty acids. Polyoxyethylene block copolymers typically comprise molecules having large segments of ethylene oxide coupled with large segments of propylene oxide. These nonionic surfactants are well known for use in this art area. The lipophilic moieties and cationic groups comprising amino or quaternary nitrogen groups can provide surfactant properties to molecules. As the name implies to cationic surfactants, the hydrophilic moiety of the nitrogen bears a positive charge when dissolved in aqueous media. The soluble surfactant molecule can have its solubility or other surfactant properties enhanced using low molecular weight alkyl groups or hydroxy alkyl groups. Cationic surfactants can be used in the acidic or basic compositions of the invention. One preferred cationic surfactant material is an oxygen containing amine compound such as an amine oxide. The preferred class of cationic surfactants include tertiary amine oxide surfactants. Tertiary amine oxide surfactants typically comprise three alkyl groups attached to an amine oxide (N→O). Commonly the alkyl groups comprise two lower ($C_{1-4}$) alkyl groups combined with one higher $C_{6-24}$ alkyl groups, or can comprise two higher alkyl groups combined with one lower alkyl group. Further, the lower alkyl groups can comprise alkyl groups substituted with hydrophilic moiety such as hydroxyl, amine groups, carboxylic groups, etc. Preferred amine oxide materials for the invention comprise dimethylcetylamine oxide, dimethyllaurylamine oxide, dimethylmyristylamine oxide, dimethylstearylamine oxide, dimethylcocoamine oxide, dimethyldecylamine oxide, and mixtures thereof. Amphoteric surfactants can be useful in the invention. Amphoteric surfactants contain both an acidic and a basic hydrophilic moiety in the structure. These ionic functions may be any of the ionic or cationic groups that have just been described previously in the sections relating to anionic or cationic surfactants. Briefly, anionic groups include carboxylate, sulfate, sulfonate, phosphonate, etc. while the cationic groups typically comprise compounds having amine nitrogens. Many amphoteric surfactants also contain ether oxides or hydroxyl groups that strengthen their hydrophilic tendency. Preferred amphoteric surfactants of this invention comprise surfactants that have a cationic amino group combined with an anionic carboxylate or sulfonate group. Examples of useful amphoteric surfactants include the sulfobetaines, N-coco-3,3-aminopropionic acid and its sodium salt, n-tallow-3-amino-dipropionate disodium salt, 1,1-bis(carboxymethyl)-2-undecyl-2-imidazolinium hydroxide disodium salt, cocoaminobutyric acid, cocoaminopropionic acid, cocoamidocarboxy glycinate, cocobetaine. Preferred amphoteric surfactants for use in the compositions of the invention include cocoamidopropylbetaine and cocoaminoethylbetaine.

The cleaner materials of the invention can contain a compatible solvent that are often used in amounts of about 0.01 to 10 wt.-% depending on soil type, soiled surface and other known variables. Suitable solvents are soluble in the aqueous cleaning composition of the invention at use proportions. Solvents can act in soil removal, composition uniformity and other actions. Preferred soluble solvents include lower alkanols, lower alkyl ethers, and lower alkyl glycol ethers. These materials are colorless liquids with mild pleasant odors, are excellent solvents and coupling agents and are typically miscible with aqueous cleaning compositions of the invention. Examples of such useful solvents include methanol, ethanol, propanol, isopropanol and butanol, isobutanol, ethylene glycol, diethylene glycol, triethylene glycol, propylene glycol, dipropylene glycol, mixed ethylene-propylene glycol ethers. The glycol ethers include lower alkyl ($C_{1-8}$ alkyl) ethers including propylene glycol methyl ether, propylene glycol ethyl ether, propylene glycol propyl ether, dipropylene glycol methyl ether, dipropylene glycol ethyl ether, tripropylene glycol methyl ether, ethylene glycol methyl ether, ethylene glycol ethyl ether, ethylene glycol butyl ether, diethylene glycol methyl ether, diethylene glycol butyl ether, ethylene glycol dimethyl ether, ethylene glycol monobutyl ether, and others. The solvent capacity of the cleaners can be augmented by using monoalkanol amines.

Other common additive materials can be used including dyes, fragrances, thickening agents, etc.

EXPERIMENTAL

Experiments conducted with various alloys of differing compositions, have established the resistance of the alloys to tarnishing by exposing pieces that have been treated to hostile environmental conditions, namely hydrogen sulfide ($H_2S$) and ammonium sulfide $(NH_4)_2S$) fumes, using similar untreated pieces as controls. The control pieces have been severely tarnished during this exposure, while the treated pieces have shown no surface discolorations. The severe conditions are believed to model tarnish prevention for greater than 30 days, often greater than 90 days and uo to one year, depending on conditions.

Preliminary experiments with various silver alloys have established that the degree of tarnishing is, in part, directly related to the amount of alloy metal in the alloy composition. A metal is used in an alloy of silver to strengthen the alloy and to make it more ductile and malleable. Generally, (e.g.) the copper content is in the range of 0.001 to 5%. Cobalt salts have the ability to retard return of tarnish deposits. Chromium nitrate is incorporated into this formulation to enhance the brightness of the silver alloy being treated. Chromium, the element, is again difficult to incorporate into molten silver, as indicated by previous work with silver alloys. However, chromium is deposited on the surface of silver alloys during the treatment process, as indicated by chemical analysis. Cobalt nitrate and chromium nitrate have been incorporated into this formulation to enhance the brightness of the silver alloy being treated. Chromium and cobalt, as metallic element, is again difficult to incorporate into molten silver, as indicated by previous work with silver alloys. However, chromium and cobalt are deposited on the surface of silver alloys during the treatment process, as indicated by chemical analysis.

EXAMPLES OF THE AQUEOUS MATERIALS

Example 1

| | |
|---|---|
| $HNO_3$ | 20 gms |
| Thiourea | 15 gms |
| $CoNO_3$ | 5 gms |
| $CrNO_3$ | 5 gms |
| $H_2O$ | 100 gms |

Plates and coin immersed for 30 minutes. Subjected to tarnish test.

Results:

Coin—not tarnished

Plate—not tarnished

Example 2

| | |
|---|---|
| $H_2O$ | 90 gms |
| Thiourea | 15 gms |
| Co $NO_3$ | 5 gms |
| Cr $NO_3$ | 5 gms |
| $HNO_3$ | 15 gms |

Solubility—complete Plates immersed 15 minutes

Some plates dipped ½ length

Results:

Controls—severely blackened

Treated plates—very slight tarnish

½ dipped plates—significant difference between dipped area and untreated area—treated area substantially free of tarnish.

Three Diamonique plates polished, treated with solution −0.5 hour

Three plates polished, not treated
All above exposed to $NH_4S$ for two hours (½ mL in 200 mL)
Two plates treated ½/ hour
Two plates, severely tarnished, ½ treated, ½ untreated
Two plates untreated as controls Example 3

| | |
|---|---|
| $H_2O$ | 130 gms |
| Thiourea | 15 gms |
| Co $NO_3$ | 6 gms |
| Cr $NO_3$ | 6 gms |
| $HNO_3$ | 26 gms |

Plates A—10 min DIP
Plates B—30 min DIP
Plates C—60 min DIP
Controls—No DIP
Results—Some tarnish, but less than controls Example 4

| | |
|---|---|
| $H_2O$ | 130 gms |
| Thiourea | 15 gms |
| Co $NO_3$ | 6 gms |
| Cr $NO_3$ | 6 gms |
| $HNO_3$ | 39 gms |

Plates E—10 min DIP
Plates F—30 min DIP
Plates G—60 min DIP
Controls—DIP
Tarnish resistance—good Example 5

| | |
|---|---|
| $H_2O$ | 130 gms |
| Co $NO_3$ | 6 gms |
| Thiourea | 15 gms |
| Cr $NO_3$ | 6 gms |
| $HNO_3$ | 30 gms |
| HCl | 10 gms |

All thiourea did not dissolve
Plates X—15 min DIP
Plates T—25 min DIP
Plates O—10 min DIP
Results
X—Tarnished, less than control
T—Slight tarnish
O—Very slight tarnish
Tarnish resistance—good Example 6

| | |
|---|---|
| $H_2O$ | 130 gms |
| Thiourea | 10 gms |

-continued

| | |
|---|---|
| Co $NO_3$ | 2 gms |
| Cr $NO_3$ | 2 gms |
| $HNO_3$ | 30 gms |
| HCl | 10 gms |

Plates O—10 min DIP
Plates T—20 min DIP
Plates X—30 min DIP
Tarnished plates—dipped—tarnish immediately removed
Plates
O—Plates bright
T—Plates bright
X—Plates bright
Tarnish resistance—good Example 7

| | |
|---|---|
| $H_2O$ | 130 gms |
| Thiourea | 15 gms |
| $HNO_3$ | 20 gms |
| HCl | 10 gms |
| Co $NO_3$ | 5 gms |
| Cr $NO_3$ | 5 gms |

Solubility of all ingredients was complete
Order of addition—important
Results:
Plates 1—10 min DIP—Very slight tarnish
Plates 2—20 min DIP—No tarnish
Plates 3—30 min DIP—No tarnish
Controls—no DIP
All tarnish resistant vs. controls The testing shown above was conducted according to the following protocol. Under severe conditions of the test protocol some tarnish formation is not indicative of a problem but shows substantial resistance to tarnish in normal use.

Material Required

1. Ammonium sulfide, $(NH_4)S$, 20% solution, Reagent grade
2. Air-tight chamber, 4 cu ft volume, equipped with a platform, plastic-coated metal grid, and a container to hold the solution.
3. Sterling silver plates, all of a nationally sold alloy of sterling silver, 1½'×1½'×0.050'.

Methodology

STEP 1: The silver plates are polished, using standard polishing compounds, to a mirror finish. They are then degreased using hot water and a strong surface-cleaning detergent. They are then rinsed and immediately dried and stored in anti-tarnish cloth wrapping.

STEP 2: To determine the efficacy of the dip solution, some of the plates are immersed in the solution for the prescribed time interval, and then removed, rinsed with distilled water, and dried.

STEP 3: A solution of ammonium sulfide is prepared using 0.25 mL of the 20% reagent in 200 mL of distilled water. This is placed in the container at the bottom of the chamber, and will produce a hostile environment of approximately 1,000 parts per million of sulfide gas.

STEP 4: The platform and grid are placed in the chamber and the silver plates (and/or other items to be tested) are placed on the grid. The chamber is then sealed and the reaction allowed to proceed; i.e., the exposure of the silver items under test to the tarnishing effects of the sulfide gas.

The reaction is complete when the control plates have become severely tarnished with a black deposit of silver sulfide uniformly coating the entire plates. A six-hour exposure time has been determined for optimum sensitivity and correlation with conditions encountered in home environments.

STEP 5: The plates (and other items) are then removed from the chamber and the degree of tarnishing evaluated using a scale of 0 to 5, where 0 indicates no tarnish, and 5 indicates a severe black/brown discoloration. The plates that have been treated with the solution are compared to the control plates, and the degree of resistance to tarnishing is recorded.

The examples shown above were used to clean and treat silver alloy, sterling silver materials. The procedure is as shown above. Each of the examples were used to clean and treat the sterling silver plates. The data shown above indicates that the material quickly removes tarnish from the surface of the silver plates and prevents the return of tarnish for a substantial period. We believe that even under the extremely severe conditions of this test protocol, the silver plates remained substantially tarnish-free for an extended period of time.

While the above specification shows an enabling disclosure of the cleaner technology of the invention, other embodiments of the invention may be made without departing from the spirit and scope of the invention. Accordingly, the invention is embodied in the claims hereinafter appended.

I claim:

1. A method of cleaning metal or metal alloy surfaces with an aqueous metal cleaning composition, the method comprises contacting a soiled metal surface with a composition comprising:

(a) water;

(b) about 10 to 40 wt % of an aqueous soluble acid to obtain a pH less than 6;

(c) about 5 to 25 wt % of thiourea; and (d) about 2 to 30 wt % of a mixture comprising a cobalt transition metal salt and a chromium transition metal salt; and removing the soil and used composition.

2. The method of claim 1 wherein the acid comprises a blend of nitric acid and hydrochloric acid.

3. The method of claim 1 wherein the mixture comprises cobalt and chromium transition metal salts selected from the group consisting of nitrates, chlorides, and combinations thereof.

4. The method of claim 1 wherein the concentration of thiourea is about 10 to about 25 wt %.

5. The method of claim 2 wherein the weight ratio of nitric acid to hydrochloric acid is about 0.01 to 1:1.

* * * * *